US008621793B2

(12) United States Patent
Abdul Lathief

(10) Patent No.: US 8,621,793 B2
(45) Date of Patent: Jan. 7, 2014

(54) GLAZING SYSTEM

(75) Inventor: Arakkal Abdul Khader Abdul Lathief, Dubai (AE)

(73) Assignee: City Glass & Glazing (P) Ltd. (IN)

( * ) Notice: Subject to any disclaimer, the term of this patent is extended or adjusted under 35 U.S.C. 154(b) by 136 days.

(21) Appl. No.: 12/261,891

(22) Filed: Oct. 30, 2008

(65) Prior Publication Data

US 2009/0113826 A1 May 7, 2009

Related U.S. Application Data

(63) Continuation-in-part of application No. 10/566,536, filed as application No. PCT/IB2004/002298 on Jul. 15, 2004, now abandoned.

(30) Foreign Application Priority Data

Jul. 30, 2003 (AE) ..... 242/2003

(51) Int. Cl.

| | |
|---|---|
| ***E06B 3/30*** | (2006.01) |
| ***E06B 3/964*** | (2006.01) |
| ***E06B 3/988*** | (2006.01) |
| ***E04C 2/32*** | (2006.01) |

(52) U.S. Cl.
USPC ..... 52/204.66; 52/204.53; 52/204.7; 52/656.5

(58) Field of Classification Search
USPC ..... 52/204.54, 204.53, 204.5, 204.62, 52/204.67, 204.69, 204.55, 204.63, 52/204.64, 656.5, 656.6
See application file for complete search history.

(56) References Cited

U.S. PATENT DOCUMENTS

| | | | | | |
|---|---|---|---|---|---|
| 2,304,423 | A | * | 12/1942 | Schiller | 52/204.7 |
| 3,455,080 | A | * | 7/1969 | Meadows | 52/476 |
| 3,774,363 | A | * | 11/1973 | Kent | 52/204.597 |
| 3,881,290 | A | * | 5/1975 | Bouchey | 52/204.593 |
| 4,524,978 | A | * | 6/1985 | Mauser | 52/718.02 |
| 4,612,743 | A | * | 9/1986 | Salzer | 52/208 |
| 4,689,933 | A | * | 9/1987 | Biro | 52/656.5 |
| 5,692,349 | A | * | 12/1997 | Guillemet | 52/204.53 |

(Continued)

FOREIGN PATENT DOCUMENTS

| | | |
|---|---|---|
| DE | 2614803 | 10/1977 |
| GB | 2237600 | 8/1991 |

(Continued)

*Primary Examiner* — Ryan Kwiecinski
(74) *Attorney, Agent, or Firm* — Rader, Fishman & Grauer PLLC

(57) ABSTRACT

A self-lock glazing mechanism of two aluminum extrusion profiles, a male profile and a female profile, to self-lock glass panels using beadings. The mechanism functions when a glass panel is positioned on setting blocks over the flat surface of the upper leg of the female profile—with spacers between the vertical leg of the female profile and the glass panel and the male profile with the locking tip facing upward on its horizontal leg inserted into the gap between the upper leg and the lower leg of the female profile against the female locking tip above. The locking tips of both male and female profiles are then engaged by tilting the vertical leg of the male profile outward about its built-in fulcrum, and inserting wedges into the space created between the glass panel and the vertical leg of the male profile, for keeping the glass panel locked in position. The mechanism further tightens grip on the edges of the glass panel when the spacers and wedges are replaced by rubber beading of appropriate resilience for glazing to avoid touching metal and to allow expansion and to absorb impacts.

10 Claims, 5 Drawing Sheets

(56) References Cited

U.S. PATENT DOCUMENTS

| | | | | |
|---|---|---|---|---|
| 5,713,159 | A * | 2/1998 | Schmidt | 52/98 |
| 5,768,837 | A * | 6/1998 | Sjoholm | 52/204.62 |
| 6,848,225 | B2 * | 2/2005 | Lapierre | 52/204.53 |
| 7,040,062 | B2 * | 5/2006 | Emek | 52/204.62 |
| 7,621,082 | B2 * | 11/2009 | Morton | 52/204.54 |
| 2002/0011040 | A1 * | 1/2002 | Adachi et al. | 52/204.597 |
| 2003/0070371 | A1 * | 4/2003 | Kobrehel | 52/204.5 |
| 2003/0159374 | A1 * | 8/2003 | Burgess | 52/204.61 |
| 2004/0231255 | A1 * | 11/2004 | Silverman | 52/204.6 |
| 2005/0055906 | A1 * | 3/2005 | Barnard | 52/204.1 |
| 2005/0246980 | A1 * | 11/2005 | Montero | 52/204.53 |
| 2006/0143996 | A1 * | 7/2006 | Alvarado | 52/204.53 |

FOREIGN PATENT DOCUMENTS

| | | |
|---|---|---|
| JP | 10184208 | 7/1998 |
| JP | 11256942 | 9/1999 |
| WO | WO2005010310 | 2/2005 |

* cited by examiner

GLAZING SYSTEM

CROSS-REFERENCE TO RELATED APPLICATIONS

This is a continuation-in-part of co-pending U.S. patent application Ser. No. 10/566,536, filed Jan. 30, 2006, which is incorporated herein by reference.

Priority of International Application No. PCT/IB2004/002298, filed Jul. 15, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The current invention relates to a unique and compact self-lock glazing system composed of two aluminum extrusion profiles—a male profile and a female profile—designed in such a way to self-lock glass panels using beadings. The mechanism functions when a glass panel is positioned on setting blocks over the flat surface of the upper leg of the said female profile—with spacers between the vertical leg of the said female profile and the said glass panel (as illustrated in FIGS. 3,4,5,6,7,8) and the said male profile with the locking tip facing upward on its horizontal leg inserted into the gap between the upper leg and the lower leg of the said female profile against the female locking tip above. The locking tips of both male and female profiles are then engaged by tilting the vertical leg of the said male profile outward about its built-in fulcrum, and inserting wedges into the space so created between the said glass panel and the vertical leg of the male profile, for keeping the said glass panel locked in position. The mechanism further tightens grip on the edges of the said glass panel when the said spacers and wedges are replaced by rubber beadings of appropriate resilience (which is mandatory for glazing to avoid touching metal, to allow expansion and to absorb impacts).

The introduction of the said rubber beadings lends a unique dynamism to the mechanism. The inherent resilience of rubber beadings causes a mating action in the locking chamber and the resulting equal and opposite reactions keeps the glass pane lin equilibrium between the vertical tips of both the said male and female profiles by means of the built-in fulcrum.

This balancing act of forces remains in the locking system throughout the life of the beadings.

2. General Background of the Invention

U.S. Pat. No. 5,007,221 entitled "snap-in glazing pocket filler" was disclosed a snap-in pocket filler for use with a structural frame member having an unused glazing pocket, or for use as gap filler on aluminum profiles to cover the unused area for aesthetic reason.

It was noticed that a proper glazing system was lacking in the market to meet the increasing demand for thicker glazing (e.g. shop fronts and partitions) and it has become a necessity for those skilled in the art to develop a system which must be simple, technically safe and aesthetically impressive.

The following U.S. patents are incorporated herein by reference:

TABLE

| PATENT NO. | TITLE | ISSUE DATE |
|---|---|---|
| 3,774,363 | Glazing Window or Windscreen Openings, Particularly in Vehicle Bodies | Nov. 27, 1973 |
| 3,881,290 | Glazed Impervious Sheet Assembly and Method of Glazing | May 06, 1975 |
| 4,689,933 | Thermally Insulated Window Sash Construction for a Casement Window | Sep. 01, 1987 |
| DE2614803 | GLASFALZLEISTE | Oct. 27, 1977 |
| JP10184208 | Fitting to Which Glass and the Like can be Easily Attached/Detached | Jul. 14, 1998 |
| JP11256942 | Glazing Gasket | Sep. 21, 1999 |
| UK2237600 | Preventing Removal of Glazing Bead | May 08, 1991 |

BRIEF SUMMARY OF THE INVENTION

Aluminum glazing profiles generally available in the market are intended for standard window glazing only. These profiles are used by many people for bigger partition walls with thicker glazing, compromising safety, quality and aesthetic appeal as no other options are available for glazing big partition walls with thicker glass panels than window pane glasses. For maximum visibility of the showrooms, designers insist on frameless glazing with thin frames around the glass panel. Technicians use U channels, in which glass panels are allowed to stand free but these tend to move horizontally due to loose fixing with silicone at the ends.

Some professional pioneers like Dorma (Germany) developed heavy profiles for thicker glass application which require fastening by screws that further should be covered for aesthetic reasons and consequently the work becomes complicated, laborious and eventually expensive. In view of the above factors and considering the demand for faster glazing, the current invention emphasizes the issue of safety while addressing the importance of aesthetic appeal, allowing enough clearance for glazing (so that one could decide the glass size before installing frames at site) and making site installation easy.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 3, 4, 5, 6, 7:
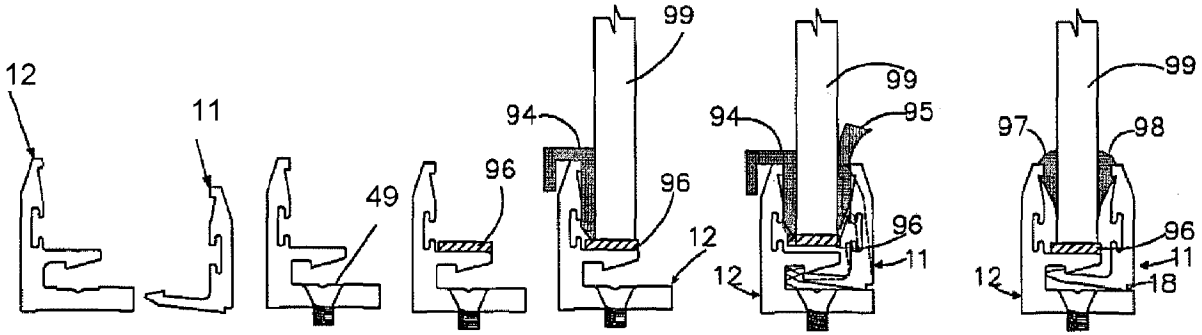
FIG. 1 is a female profile.
FIG. 2 is a male profile.
FIG. 3 is a structural fixing of the female profile using a screw.
FIG. 4 is glass packing on the female profile (minimum 2 per glass panel)
FIG. 5 is a glass panel (suitable to the frame size) placed over the female profile.
FIG. 6 is the horizontal leg of the male profile introduced through the gap between the upper leg and the lower leg of the female profile and the vertical leg of the male profile is tilted outward on its built-in fulcrum to engage the lock, then wedges are introduced to keep the lock engaged so that glass panel is locked in position.
FIG. 7 is a view of grooved rubber beadings which are introduced in between the gaps of profiles from both sides of the glass panel.
Figure 1A:
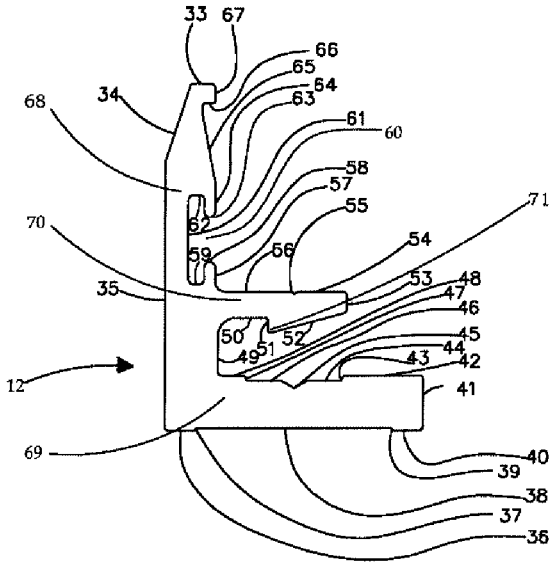
FIG. 1A is a female profile with reference characters.
Figure 2A:
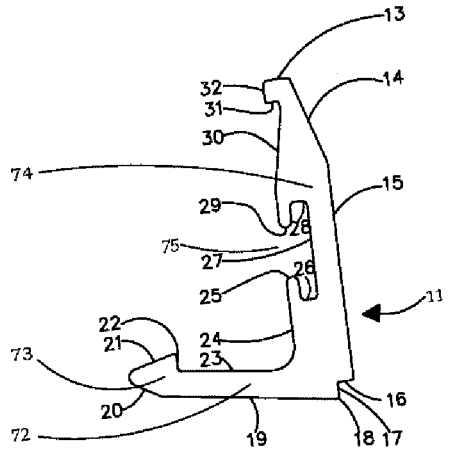
FIG. 2A is a male profile with reference characters.
Figure 6A:
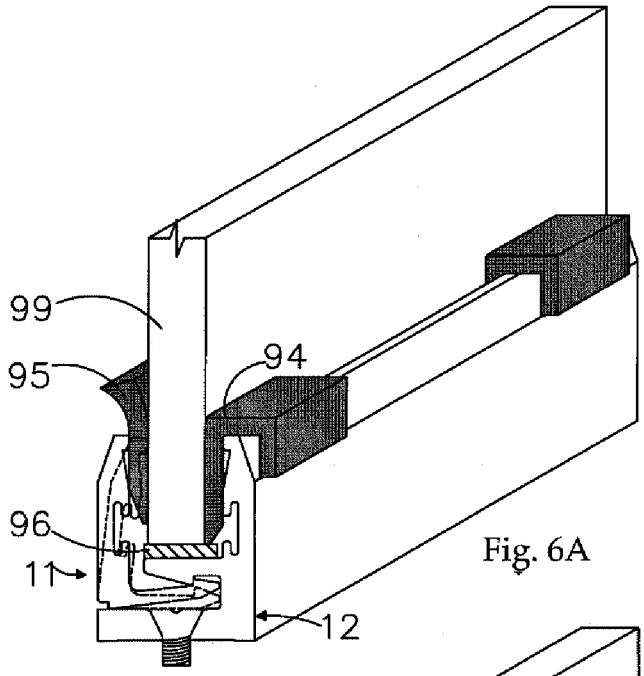
FIG. 6A is a perspective view of the self-lock glazing system showing the spacers.
Figure 6B:
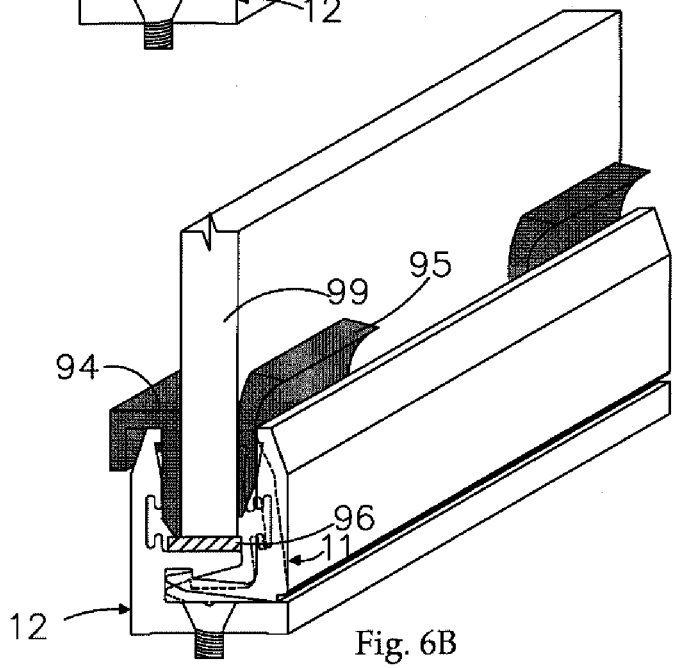
FIG. 6B is a perspective view of the self-lock glazing system showing the wedges.
Figure 7A:
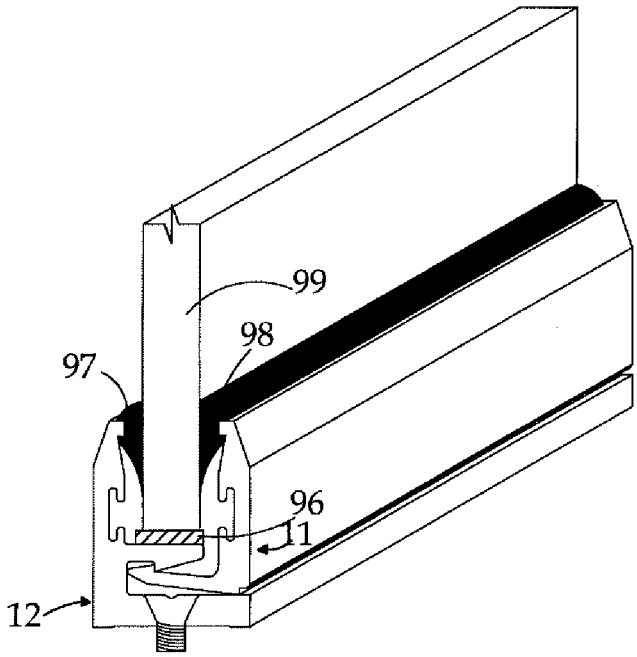
FIG. 7A is a perspective view of the self-lock glazing system with glass panel in position and the rubber beadings are introduced.
Figure 9:
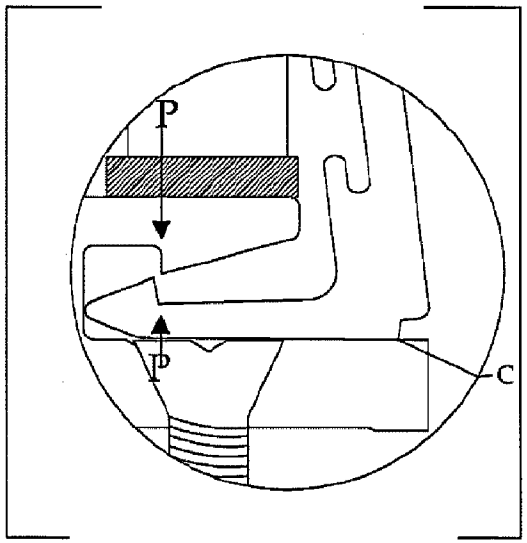
FIG. 9 are details of the locking tips of FIG. 8.
Figure 8:
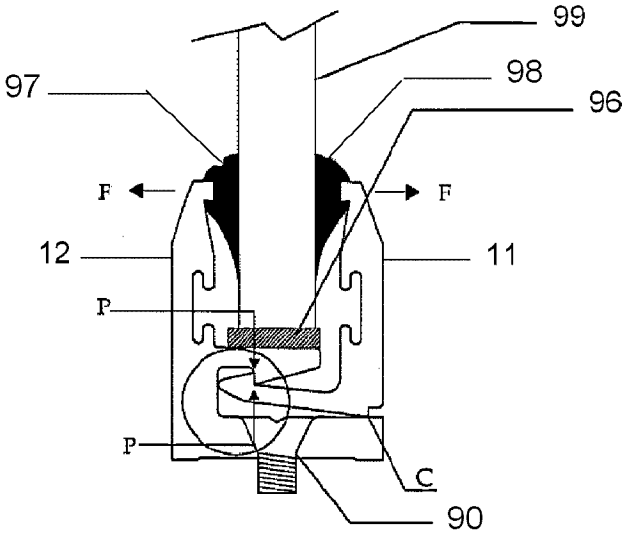
FIG. 8 is a side view of the mechanism of the glazing system.

The self-lock glazing system consists of two extruded aluminum profiles, a male profile 11, FIG. 2A and a female profile 12, FIG. 1A as described in the succeeding paragraphs, designed in such a way to create a secure space for keeping glass panels safely and tightly in position. The important aspect of the invention is that when a glass panel 99, FIG. 7 is placed on the upper leg 70 of the female profile 12 and the male profile 11 is inserted and rubber beadings 97, 98 are forced in (by hand) between the said glass panel 99 and the profiles 12, 11 respectively creates outward forces F, FIG. 8 on the vertical tips of the said profiles (forcing them apart). The turning moment at the pivotal fulcrum 18 of the said male profile 11 forces the locking system together because of the complementary locking tips 73 and 71 provided on the profiles as a result, the system interlocks and thus arrest the profiles (11 and 12) in position; eventually the said glass panel 99 held in guard (under the pressure of the beadings 98 and 97) of the said vertical tips (32, FIGS. 2A and 67, FIG. 1A) remains locked.

The self-lock glazing system comprising:

(a) A female profile 12, FIG. 1A, the female profile 12 is a right angled profile having a lower leg 69 as base, an upper leg 70 and an upward vertical leg 68. The upper leg 70 is the horizontal cantilever extension from the lower half portion of the vertical leg 68.

The vertical leg 68 originates from the horizontal lower leg 69 at the base and has a vertical face 35 which ends at about three-fourth the height of the vertical leg 68 to join an inclined surface 34 which terminates at the horizontal tip 33 with adjoining vertical face 67. The vertical face 67 acts as the link for transfer of forces between the glass panel 99, FIG. 5 and the female profile 12 and also helps to retain the rubber beading. The vertical face 67 is followed by a horizontal face 66 below that ends to a sloping face 65 which leads to the inside wall 64 of the vertical leg 68 that extends down to form a groove 60.

The said groove 60 comprises an upper projection 63, an upper recess 62, followed by the vertical wall 61 which is parallel to the exterior wall 35, a lower recess 59 and a bottom projection 58. The bottom projection 58 is followed by another vertical face 57 that curves down to join the upper face 56 of the upper leg 70.

The upper leg 70 which is the horizontal cantilever extension from the lower half portion of the vertical leg 68, has an upper flat surface formed by 56 and 54 and a groove 55 in between, and this leg 70 terminates approximately at two-thirds of the length of the lower leg 69 at tip 53 and its bottom has a downwardly sloping protrusion 52 with a female locking tip 71 with a mating face 51 followed by an upper horizontal surface 50 that curves down to the vertical wall 49 to form the locking chamber facing downward to the gap formed by the remaining portion of the inside wall 49 and the adjacent upper surface 48 up to 42 of the lower leg 69; this gap provides access to the said locking chamber.

The said vertical faces 67, 64, 57 and 49 are all in a same straight line and defines the inside wall of the said female profile 12. The recess formed by the sloped face 65 is for accommodating the allowances provided in the grooved rubber beadings.

The top surface of the lower leg 69 is flat in general, and this top surface starts with a horizontal surface 48 adjacent to the inner vertical wall 49 and this horizontal surface 48 defines the general level of the top surface. On the other end of the leg there is another horizontal surface 42 which is of same level as 48. The horizontal surface 42 at the other end plays a vital role in the system since it acts as the base for acting the built-in fulcrum 18 in the said male profile 11. The upper surfaces 48 and 42 of the lower leg 69 have two lower horizontal faces 46 and 44 in between with a 'v' shaped groove 45 at its centre. The recessed surface 46 is connected to the surface 48 with an inclined surface 47. The horizontal recessed surface 44 is connected with the surface 42 by an inclined surface 43. The 'v'-shaped groove 45 at the centre acts as a guidance for drilling holes for countersunk screws for fastening the female profile 12 to the structure. There is another 'v' shaped groove 55 on the flat surface on top of the upper leg 70 that facilitates ease of drilling a hole for access to the 'v' shaped groove 45 vertically below. The 'v'-shaped grooves 45 and 55 are required to ensure precision and accuracy of the installation of the glazing system and also to make drilling easier and to the point.

Adjacent to the horizontal surface 42, a vertical face 41 goes down to the bottom surface of the horizontal leg 69 and this vertical surface 41 comes in the same line with the outer surface 15 of the said male profile 11 when the system is engaged. The bottom surface of the lower leg of the said female profile 12 has two symmetrical projections 36 and 40 at the ends with recess 38 at centre for proper seating. The recess 38 is connected to projection 36 and 40 with inclined surfaces 37 and 39 respectively.

b) A male profile 11, FIG. 2A, the said male profile 11 is an acute angled profile consisting of a horizontal leg 72 with a locking tip 73 at one end and vertical leg 74 at the other end. The horizontal leg 72 is the base with a lower surface 19 starting from the lower face 20 of the locking tip 73, and ends with the built-in fulcrum 18 with an adjoining recess formed by vertical face 17 and a horizontal face 16. The vertical leg 74 starts from the said recess with a surface 15 inclined forward and ends at another inclined face 14 which is further inclined inward to join the horizontal tip 13.

The locking tip 73 comprising an upward sloping surface 20 turns to form another upward sloping surface 21, and an adjoining dropping down face 22 combines to form a unique shape to the locking tip 73. The upper surface 23 of the horizontal leg 72 curves upward to join the inner vertical wall 24 which extends up to a groove 75.

The said groove comprising a lower projection 25, an upper projection 29, a lower recess 26, an upper recess 28 with a vertical wall 27 that is parallel to the exterior wall 15, a top projection 29, joins the interior wall which slopes upward forming an inclined surface 30 which terminates at the horizontal surface 31. The horizontal surface 31 ends to a vertical face 32 that joins the horizontal tip 13.

The horizontal tip 13 together with a vertical surface 32 and a bottom surface 31 helps to retain the rubber beadings.

The mechanism functions when a glass panel 99 is positioned on packing 96 over the upper leg 70 of the said female profile with spacers 94 between the vertical leg 68 of the said female profile 12 and the said glass panel 99, and then inserting the horizontal leg 72 of the said male profile 11 with its locking tip 73 facing upward into the gap between the lower leg 69 and upper legs 70 of the said female profile, then engaging the locking tips of both male and female profiles by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system; the mechanism further tightens its grip on the edges of the locked glass panel 99 when the spacers 94 and wedges 95 are replaced by rubber beadings 97 and 98 of appropriate resilience which enables the said glass panel 99 to remain in an equilibrium throughout the life of the beading. The vertical plane passing through the centre of the glass panel 99 will intersect both the male profile 11 and female profile 12, and also intersect the gap of the female profile 12 and the leg 72 of the male profile 11. Then the horizontal tip 33 of the vertical leg 68 of the said female profile 12 and the horizontal tip 13 of the vertical leg 74 of the said male profile 11 are located at the same height when the glass panel 99 is positioned and the lock is engaged by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system.

METHOD OF INDUSTRIAL APPLICATION OF THE INVENTION

The scientific principles used are the Newton's Law of Motion, the property of elasticity of the rubber and the transmission of the rotational moments of the moving parts around the fulcrum. The following explanation is read in relation to FIG. 8

F—Outward force (due to the resilience of rubber beading

P—Inward force (creating the locking)

C—Fulcrum point

Insertion of the rubber between the glass panel and the upper tips of the vertical legs of profiles creates outward forces (F) to the legs of both profiles forcing them apart. A turning moment at the pivotal fulcrum (C) forces the locking system together (P).

The locking system functions due to the combination of a pair of hooking tips and the fulcrum built in the legs of the male and female profiles mating in the locking chamber while retaining the pivotal mating profile (male) firmly in position and the glass panel which is under the grip of the said vertical tips are eventually remain locked.

The pre-determined variables are the sizing of the glass panel and that of the rubber beading. In this arrangement any external forces applied due to conditions like wind or vibrations caused by physical movements—whose action may act to dislodge the glass from its set position—only acts to further tighten the fastening mechanism of the system to arrest the glass panel in position.

The invention claimed is:

1. A self-locking glazing system for locking a glass panel, the system comprising:

a glass panel having a width;

a first rubber beading and a second rubber beading;

an aluminum extruded female profile having a lower leg, a first vertical leg, and an upper leg, the upper leg extending as a horizontal cantilever extension from a lower half portion of the first vertical leg and extending at a length that exceeds the width of the glass panel such that the width of the glass panel is entirely positioned on the upper leg; and an aluminum extruded male profile having a generally horizontal leg and a second vertical leg; and wherein a gap is formed in the female profile between the lower leg and the upper leg, and wherein the upper leg includes a horizontal surface on a bottom side of the upper leg, and the upper leg includes a mating face orthogonal to and coincident with the upper surface;

wherein the glass panel is configured to be positioned between the first vertical leg and the second vertical leg;

wherein the horizontal leg of the male profile includes a locking tip having a dropping down face that engages against the mating face of the upper leg of the female profile;

wherein the first vertical leg includes a first horizontal tip orthogonal to a first vertical face that is directed toward the glass panel, and the first vertical leg includes a first horizontal face orthogonal to the first vertical face, and wherein the second vertical leg includes a second horizontal tip orthogonal to a second vertical face that is directed toward the glass panel, and the second vertical leg includes a second horizontal face orthogonal to the second vertical face;

wherein the first rubber beading is positioned between the first vertical face and the glass panel and the first rubber beading is in contact with the first vertical face, and the second rubber beading is positioned between the second vertical face and the glass panel and the second rubber beading is in contact with the second vertical face, thereby causing an outward force to be applied at least to the first vertical face and the second vertical face such that an engaging force is maintained about a fulcrum of the male profile and between the dropping down face of the horizontal leg of the male profile and the mating face of the upper leg of the female profile; and wherein the male profile rests on the fulcrum over the lower leg of the female profile, and wherein the horizontal leg of the male profile extends from the fulcrum and rotates about the fulcrum.

2. The self-locking glazing system of claim 1 wherein insertion of the first and second rubber beadings causes outward force (F) to be applied against the first vertical face and the second vertical face and forcing the first and second vertical legs apart, such that a pivotal fulcrum (C) occurs at the fulcrum of the male profile forcing a locking system (P) together between the dropping down face of the leg of the male profile and the mating face of the upper leg of the female profile.

3. The self-locking glazing system of claim 1 wherein the first horizontal tip and the second horizontal tip are located at the same height with respect to the glass panel.

4. The self-locking glazing system of claim 1 comprising a packing positioned between the glass panel and the upper leg.

5. The self-locking glazing system of claim 1 comprising a first v-shaped groove positioned in the lower leg of the female profile, wherein the first v-shaped groove acts as a guidance for drilling holes for countersunk screws for fastening the female profile to a structure.

6. The self-locking glazing system of claim 5 comprising a second v-shaped groove positioned in the upper leg of the female profile, and positioned to facilitate ease of drilling the holes in the lower leg of the female profile.

7. The self-locking glazing system of claim 1 wherein the horizontal leg of the male profile and the second vertical leg of the male profile form an acute angle therebetween.

8. The self-locking glazing system of claim 1 wherein a bottom surface of the lower leg of the female profile includes two symmetrical projections extending therefrom, and a recess therebetween.

9. The self-locking glazing system of claim 1 wherein a first groove is formed in the first vertical leg of the female profile and having an opening facing toward the glass panel, the first groove partially enclosed by a first upper projection, a first upper recess, a first lower recess, and a first bottom projection, and wherein a second groove is formed in the second vertical leg of the male profile and having an opening facing toward the glass panel, the second groove partially enclosed by a second upper projection, a second upper recess, a second lower recess, and a second bottom projection.

10. The self-locking glazing system of claim 1, wherein a turning moment at the fulcrum is created by the outward force that locks together the mating face and the dropping down face to interlock the system and arrest the male profile and the female profile in position.

* * * * *